US006792955B1

(12) United States Patent
Newell

(10) Patent No.: US 6,792,955 B1
(45) Date of Patent: Sep. 21, 2004

(54) APPLICATOR BRUSHES AND METHOD FOR APPLYING MASCARA

(76) Inventor: Robert L. Newell, 36 Passaic Ave., West Paterson, NJ (US) 07424

( * ) Notice: Subject to any disclaimer, the term of this patent is extended or adjusted under 35 U.S.C. 154(b) by 0 days.

(21) Appl. No.: 09/993,527

(22) Filed: Nov. 14, 2001

Related U.S. Application Data

(60) Provisional application No. 60/283,475, filed on Apr. 12, 2001, and provisional application No. 60/252,559, filed on Nov. 22, 2000.

(51) Int. Cl.[7] ..... A45D 40/26

(52) U.S. Cl. ..... 132/218

(58) Field of Search ..... 132/200, 218, 132/313; 15/207.2, 206; 428/400, 369

(56) References Cited

U.S. PATENT DOCUMENTS 4,733,425 A * 3/1988 Hartel et al. ..... 132/218
4,887,622 A * 12/1989 Gueret ..... 132/218
5,022,112 A * 6/1991 Burns ..... 15/159 A
5,032,456 A * 7/1991 O'Brien et al. ..... 428/398
5,161,554 A * 11/1992 Fitjer ..... 132/218
5,161,555 A * 11/1992 Cansler et al. ..... 132/218
5,611,361 A * 3/1997 Leone ..... 132/218
5,976,692 A * 11/1999 Brezler, III et al. ..... 428/372
6,174,600 B1 * 1/2001 Brown et al. ..... 428/372
6,237,609 B1 * 5/2001 Vasas ..... 132/218
6,311,359 B1 11/2001 Brezler, III

* cited by examiner

*Primary Examiner*—Todd E. Manahan
(74) *Attorney, Agent, or Firm*—Arthur Jacob

(57) ABSTRACT

A brush for applying mascara to eyelashes includes bristles constructed of a polyamide fiber having an external surface modified to include a texturized surface configuration having a multiplicity of spaced apart indents. The bristles have a diameter of about 2.5 to 3,5 mils and are arranged in a spiral having plural turns, with more than 60 and up to about 120 bristles within each turn of the spiral arrangement. A method utilizes the improved brush to facilitate the application of mascaras in a wider range of viscosities.

8 Claims, 1 Drawing Sheet

APPLICATOR BRUSHES AND METHOD FOR APPLYING MASCARA

This application claims the benefit of Provisional application U.S. Ser. No. 60/252,559, filed Nov. 22, 2000, and Provisional application U.S. Ser. No. 60/283,475, filed Apr. 12, 2001.

The present invention relates generally to applicator brushes and method and pertains, more specifically, to applicator brushes and method for applying mascara to eyelashes as well as for applying other liquid and gel-like materials to similar surfaces.

The usual construction of a brush for applying mascara to eyelashes employs tufts of bristles placed in a spiral around a twisted wire support. One such brush is described in detail in U.S. Pat. No. 4,887,622, the substance of which is incorporated herein by reference thereto. The present invention constitutes an improvement over the brush disclosed in the aforesaid patent in that the particular materials used for the filaments which comprise the bristles of the present brushes, as well as the construction of the brushes themselves, accomplish an improved method for the application of mascara and similar liquid and gel-like materials, enabling a smoother, more uniform application of materials in a wider range of viscosities with increased ease.

The present invention attains several objects and advantages, some of which are summarized as follows: Provides brushes and method for applying mascara to eyelashes, the brushes and method having enhanced pick-up of mascara to be applied to the eyelashes and subsequent enhanced release of mascara to the eyelashes; accomplishes a better controlled and more uniform application of mascara, enabling the attainment of greater satisfaction among even the least skilled of users; avoids an unwanted excessive build-up of mascara on the brushes for greater ease of application and for reduction of waste; promotes the use of correct amounts of mascara, placed appropriately on the eyelashes for tastefully aesthetic results, with minimal skill; facilitates the application of mascaras in a wider range of viscosities; enables economical manufacture of brushes in large enough numbers to encourage widespread adoption and use of the brushes and method; provides brushes of uniform high quality capable of exemplary performance over a desirable service life.

The above objects and advantages, as well as further objects and advantages, are attained by the present invention which may be described briefly as providing, in a brush for applying mascara to eyelashes, wherein the brush includes bristles placed in a spiral arrangement having plural turns around a support, the improvement wherein the bristles are constructed of a polyamide fiber having an external surface modified to include a texturized surface configuration having a multiplicity of indents spaced apart from one another along and around the texturized surface configuration for providing enhanced pick-up of mascara to be applied to the eyelashes, and subsequent enhanced release of the mascara to the eyelashes, the bristles have a diameter of about 2.5 to 3.5 mils and the brush has more than 60 and up to about 120 bristles within each turn of the spiral arrangement.

In addition, the present invention provides, in a method for applying mascara to eyelashes with a brush having bristles placed in a spiral arrangement including plural turns around a support, the improvement wherein the mascara is first picked up on bristles constructed of a polyamide fiber having an external surface modified to include a texturized surface configuration having a multiplicity of indents spaced apart from one another along and around the texturized surface configuration, and subsequently releasing the picked-up mascara to the eyelashes, the bristles having a diameter of about 2.5 to 3.5 mils and the brush having more than 60 and up to about 120 bristles within each turn of the spiral arrangement.

The invention will be understood more fully, while still further objects and advantages will become apparent, in the following detailed description of preferred embodiments of the invention illustrated in the accompanying drawing, in which.

Figure 1:
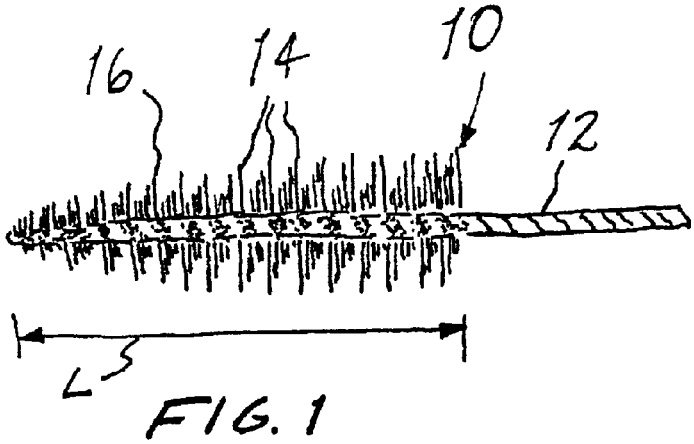
FIG. 1 is a side elevational view of an applicator brush constructed in accordance with the present invention.

Referring now to the drawing, and especially to FIG. 1 thereof, an applicator brush constructed in accordance with the present invention is illustrated at 10. Brush 10 is seen to include a twisted wire support 12 carrying bristles 14 placed in a spiral or helical array 16 extending along the length L of the brush 10, in the manner described in the aforesaid patent in connection with the illustration of a conventional make-up brush for eyelashes. The present applicator brush 10 employs bristles 14 constructed of a polyamide material; however, the polyamide material of bristles 14 is a texturized nylon fiber available commercially from E.I. du Pont de Nemours and Company, Wilmington, Del., under the designation "DuPont Texturized Fine Filament" described as 6.12 Nylon with surface modifying additive. Unlike the Nylon 6.6 or Nylon 6.10 disclosed in the aforesaid patent as including capillary channels in each fiber, the texturized nylon of the present brush 10 provides the bristles 14 with an external surface 18 modified for improved pick-up and release of the material being applied by the brush 10, and especially where the applied material is mascara in a wider range of viscosities.

Figure 2:
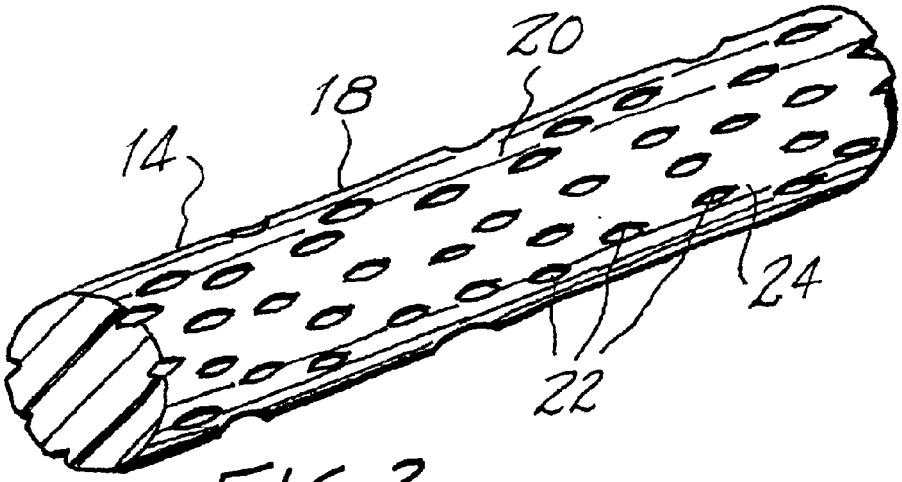
FIG. 2 is an enlarged isometric view, partially diagrammatic, of a fragment of a single bristle of the brush.

As seen in FIG. 2, the modified external surface 18 includes a textured surface 20 established by a multiplicity of indents 22 extending along and forming a relatively rough surface area 24 as opposed to a smoother surface area bearing more regular capillary channels in each fiber. Indents 22 essentially are discrete and are spaced from one another longitudinally along the external surface 18 and circumferentially around the surface 18.

The bristles 14 of brush 10 are essentially cylindrical and have a diameter in the range of about 2.5 mils to about 3.5 mils, with the preferred diameter being 3.0 mils. The wire used for support 12 has a diameter in the range of about 0.010 to 0.0195 inch. The number of bristles 14 per turn in the helical array 16 is more than 60 and up to about 120. The preferred overall length L of the helical array 16 is about 26 mm.

Figure 3:
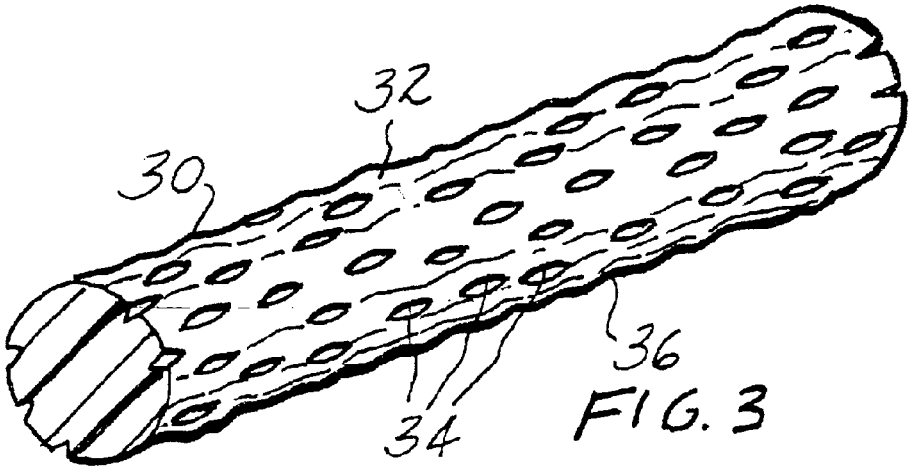
FIG. 3 is an enlarged isometric view, partially diagrammatic, similar to FIG. 2 and showing an alternate bundle construction.

In the embodiment shown in FIG. 3, an alternate bristle 30 also is constructed of a polyamide material; however, the polyamide material of bristle 30 is a nylon available from E.I. du Pont de Nemours and Company, Wilmington, Del., under the designation NATRAFIL described as 6.12 Nylon with a modifying additive. Unlike the Nylon 6.6 or Nylon 6.10 disclosed in the aforesaid patent, bristle 30 is provided with a modified structure which has not only an external surface 32 modified to include a m multiplicity of spaced apart indents 34, as described above, but is further modified to provide a non-uniform wavy appearance 36, as described in U.S. Pat. No. 5,976,692, the substance of which patent is incorporated herein by reference thereto. The modified construction enables bristles 30 to provide more effective pick-up and release of mascara in a wider range of viscosities, as well as the further advantages summarized above.

Bristles 30 are essentially cylindrical and have a diameter in the range of about 2.5 mils to about 3.5 mils, the preferred material being designated as NATRAFIL #TYN 1437, WT 117, 0.003 inch, 220 strand, the diameter of which is 3.0 mils. The number of bristles 30 per turn in a helical array, as described above, is greater than 60 and up to about 120.

The relatively small diameter of bristles 14 and 30 tend to impart a highly desirable quality of low stiffness, rendering bristles 14 and 30 more similar in stiffness to natural bristles, as compared to larger diameter bristles of synthetic polymeric materials. Modification of the external surfaces 18 and 32 of the bristles 14 and 30, respectively, as described above, provides the smaller diameter bristles 14 and 30 with desirable pick-up and release properties. These desirable properties, combined with the relatively large number of bristles per turn in the helical array of bristles in brushes constructed in accordance with the present invention enables exemplary pick-up and release performance when used in connection with the application of mascara, while deterring the pick-up of excessive amounts of mascara and the uncontrolled release and deposit of unwanted and uneven excessive amounts of mascara at the eyelashes. Accordingly, brushes constructed in accordance with the present invention facilitate the application of mascaras in a wide range of viscosities so that even those unskilled in applying mascara to the eyelashes can obtain satisfactory and aesthetically pleasing results with ease, and without waste.

It will be seen that the present invention attains all of the objects and advantages summarized above, namely: Provides brushes and method for applying mascara to eyelashes, the brushes and method having enhanced pick-up of mascara to be applied to the eyelashes and subsequent enhanced release of mascara to the eyelashes; accomplishes a better controlled and more uniform application of mascara, enabling the attainment of greater satisfaction among even the least skilled of users; avoids an unwanted excessive build-up of mascara on the brushes for greater ease of application and for reduction of waste; promotes the use of correct amounts of mascara, placed appropriately on the eyelashes for tastefully aesthetic results, with minimal skill; facilitates the application of mascaras in a wider range of viscosities; enables economical manufacture of brushes in large enough numbers to encourage widespread adoption and use of the brushes and method; provides brushes of uniform high quality capable of exemplary performance over a desirable service life.

It is to be understood that the above detailed description of preferred embodiments of the invention is provided by way of example only. Various details of design, construction and it procedure may be modified without departing from the true spirit and scope of the invention, as set forth in the appended claims.

What is claimed is:

1. In a brush having a single support for applying mascara to eyelashes, wherein the brush includes bristles placed in a spiral arrangement having plural turns around the single support, the improvement wherein the bristles are constructed of a polyamide fiber having an external surface modified to include a texturized surface configuration having a multiplicity of indents spaced apart from one another along and around the texturized surface configuration for providing enhanced pick-up of mascara to be applied to the eyelashes, and subsequent enhanced release of the mascara to the eyelashes, the bristles have a diameter of about 2.5 to 3.5 mils and the brush has more than 60 and up to about 120 bristles within each turn of the spiral arrangement.

2. The improvment of claim 1 wherein the diameter of the bristles is 3.0 mils.

3. The improvement of claim 1 wherein the polyamide is Nylon 6.12.

4. The improvement of claim 1 wherein the external surface of the polyamide fiber is further modified to include a non-uniform wavy appearance.

5. In a method for applying mascara to eyelashes with a brush having a single support and bristles placed in a spiral arrangement including plural turns around the single support, the improvement wherein the mascara is first picked up on bristles constructed of a polyamide fiber having an external surface modified to include a texturized surface configuration having a multiplicity of indents spaced apart from one another along and around the texturized surface configuration, and subsequently releasing the picked-up mascara to the eyelashes, the bristles having a diameter of about 2.5 to 3.5 mils and the brush having more than 60 and up to about 120 bristles within each turn of the spiral arrangement.

6. The improvement of claim 5 wherein the diameter of the bristles is 3.0 mils.

7. The improvement of claim 5 wherein the polyamide is Nylon 6.12.

8. The improvement of claim 5, wherein the external surface of the fiber is further modified to include a non-uniform wavy appearance.

* * * * *